US009117423B2

(12) United States Patent
Ball et al.

(10) Patent No.: US 9,117,423 B2
(45) Date of Patent: Aug. 25, 2015

(54) ALUMINUM COPPER WRAP WIRE FOR MUSICAL INSTRUMENTS

(71) Applicant: Ernie Ball, Inc., San Luis Obispo, CA (US)

(72) Inventors: Brian N. Ball, San Luis Obispo, CA (US); James C. Harrington, Palm Desert, CA (US)

(73) Assignee: Ernie Ball, Inc., San Luis Obispo, CA (US)

( * ) Notice: Subject to any disclaimer, the term of this patent is extended or adjusted under 35 U.S.C. 154(b) by 62 days.

(21) Appl. No.: 14/150,397

(22) Filed: Jan. 8, 2014

(65) Prior Publication Data

US 2015/0143972 A1 May 28, 2015

Related U.S. Application Data

(60) Provisional application No. 61/909,195, filed on Nov. 26, 2013.

(51) Int. Cl.
*G10D 3/10* (2006.01)

(52) U.S. Cl.
CPC ..... *G10D 3/10* (2013.01)

(58) Field of Classification Search
CPC ..... G10D 3/10; G10D 1/08; G10D 1/005; D07B 2205/10; D07B 1/02; D07B 1/162; D07B 1/165; C22C 38/02; C22C 38/04; C22C 38/44; C22C 38/001; C22C 38/42; C22C 38/50; C22C 38/52; C22C 45/02
USPC ..... 84/297 R, 297 S, 293
See application file for complete search history.

(56) References Cited

U.S. PATENT DOCUMENTS

| | | | | |
|---|---|---|---|---|
| 2,641,949 | A | 6/1953 | Jensen | |
| 3,099,595 | A | 7/1963 | Allbaugh | |
| 3,826,171 | A | 7/1974 | Kaar | |
| 5,578,775 | A | 11/1996 | Ito | |
| 7,705,241 | B2 | 4/2010 | Steward, Jr. et al. | |
| 7,893,331 | B2 | 2/2011 | Klanner | |
| 8,049,088 | B2 | 11/2011 | Richter | |
| 8,222,504 | B1 | 7/2012 | Ball | |
| 8,283,539 | B2 | 10/2012 | Landtroop | |
| 2010/0071529 | A1 * | 3/2010 | Infeld | 84/297 S |
| 2011/0219933 | A1 | 9/2011 | Klanner | |
| 2013/0269501 | A1 | 10/2013 | Brian et al. | |

FOREIGN PATENT DOCUMENTS

| | | | | |
|---|---|---|---|---|
| CN | 102560318 A | * | 7/2012 | C23C 4/08 |
| JP | 2013216973 A | * | 10/2013 | C23C 4/08 |
| WO | 9636038 A1 | | 11/1996 | |

* cited by examiner

*Primary Examiner* — Kimberly Lockett
(74) *Attorney, Agent, or Firm* — Leech Tishman Fuscaldo & Lampl; Denton L. Anderson

(57) ABSTRACT

A string for a musical stringed instrument includes (a) a core wire and (b) a wrap wire coiled tightly around the core wire. The wrap wire is an aluminum-copper alloy having between about 2 wt % and about 10 wt % aluminum.

10 Claims, 4 Drawing Sheets

ALUMINUM COPPER WRAP WIRE FOR MUSICAL INSTRUMENTS

RELATED APPLICATION

This application claims priority from U.S. patent application Ser. No. 61/909,195, filed on Nov. 26, 2013, entitled "ALUMINUM COPPER WRAP WIRE FOR MUSICAL INSTRUMENTS," the entirety of which is incorporated herein by reference.

FIELD OF THE INVENTION

This invention relates generally to musical instrument strings and, more specifically, to metallic musical instrument wrap wire strings for musical instruments.

BACKGROUND OF THE INVENTION

Wrapped musical instruments strings typically employ a core wire principally comprised of spring tempered high-carbon steel. (Typically, such wrapped strings ["wound strings"] are used for strings providing the lower notes on the instrument. For example, wrapped strings are typically used on all strings of a bass guitar, the four bass strings of a steel-string acoustic guitar, the three bass strings of a six-string electric guitar, and the four bass strings of a seven-string electric guitar.)

For users of stringed musical instruments, there is a continual need for wrapped musical strings which provide increased and fuller clarity and brightness.

SUMMARY

The invention satisfies this need. In one aspect, the invention is a string for a musical stringed instrument comprising: (a) a core wire; and (b) a wrap wire coiled tightly around the core wire, the wrap wire comprising an aluminum-copper alloy comprising between about 2 wt % and about 10 wt % aluminum.

In another aspect, the invention is a music stringed instrument comprising the string described immediately above.

DRAWINGS

These and other features, aspects and advantages of the present invention will become better understood with reference to the following description, appended claims and accompanying drawings where:

DETAILED DESCRIPTION

Figure 1:
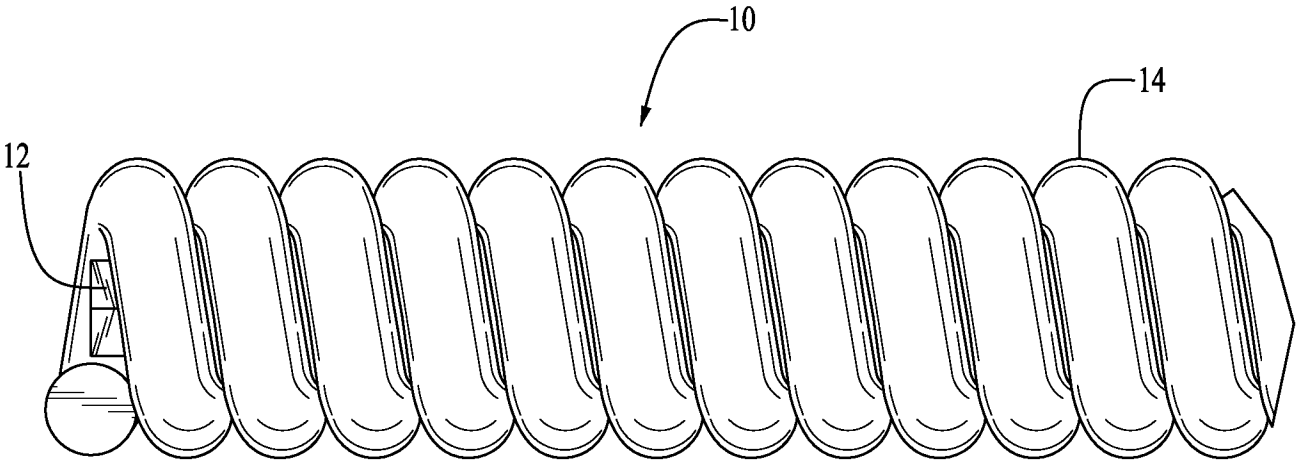
FIG. 1 is a side view of a musical instrument string having features of the invention.
Figure 2:
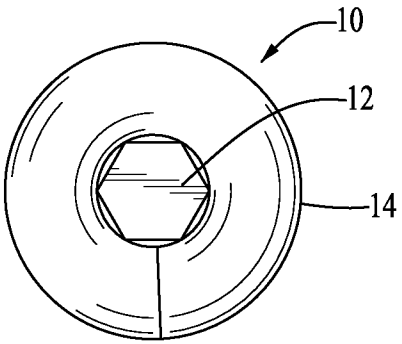
FIG. 2 is a cross-sectional view of the musical instrument string of FIG. 1, taken along line 2-2.

The following discussion describes in detail one embodiment of the invention and several variations of that embodiment. This discussion should not be construed, however, as limiting the invention to those particular embodiments. Practitioners skilled in the art will recognize numerous other embodiments as well.

In one aspect of the invention, the invention is a musical string 10 for a musical string instrument comprising (a) a core wire 12, and (b) wrap wire 14 coiled tightly around the core wire. In the invention, the wrap wire 14 comprises an aluminum bronze alloy.

In general, aluminum bronze alloys are copper alloys consisting of an addition of aluminum with a range from 2-14 wt % aluminum. However, in the invention, only aluminum bronze alloys having an aluminum content of 2-10 wt % are used. The 2% minimum is because the alloy requires a minimum amount of aluminum to provide the desired corrosion resistance. The 10% maximum is based on the manufacturability of the alloy for fine wire. Alloys containing more than 10% aluminum exceed the solubility limit of aluminum into copper and result in a multiphase structure including less ductile phases resulting in a more difficult alloy to extrude and draw into fine wire sizes. Alloys containing less than 10% aluminum are generally single phase which exhibits optimal drawability for this class of alloys thereby allowing it to be drawn to fine wire sizes to be used for strings. We came to this limit of 10% by experimental trial with manufacturing wire with alloy contents below and above 10% aluminum.

The aluminum bronze alloys may also consist of additions of up to about 2 wt % nickel, iron, manganese, iron, and/or arsenic. In our design, the optimal design consists of 5-6% aluminum with a balance of copper. The design provides a number of benefits and requires much consideration to yield a product that works well as described in the advantages of the design described below.

Corrosion Resistance

A common problem with most strings for acoustic instruments is corrosion due the use of copper alloys; however, these alloys are used due to their tonal qualities which properly voice the instrument. Other designs have sought to resolve this issue by utilizing various polymers to coat or cover the strings, however these polymers dampen the string resulting in loss of sustain and a duller sound. The present design provides greater corrosion resistance than traditional copper alloys including those used for acoustic guitar strings. This design for strings exhibits optimal sustain and tonal response while being more resistant to corrosion than traditional strings.

Manufacturability

As with any material used for wrap wire on guitar strings, the alloy must be ductile enough to draw into fine wire diameters as small as 0.004". Aluminum bronze alloys are often difficult to draw into fine wire due to their high rate of cold working and the presence of aluminum oxide on the surface. The aluminum oxides can cause wire dies to wear out quickly if the aluminum content is too high. However, the 5-6% aluminum range draws well with a low-moderate rate of cold working and does not wear out wire dies as quickly as higher concentrations of aluminum.

Tonal Response

Lastly, the tonality of the aluminum bronze provides a unique character that is pleasant and vibrant. The alloy is a very hard alloy which yields a bright and full bodied sound.

Compared with traditional copper based alloys aluminum bronze guitar strings have an increase in low end and high end frequency response.

Figure 3:
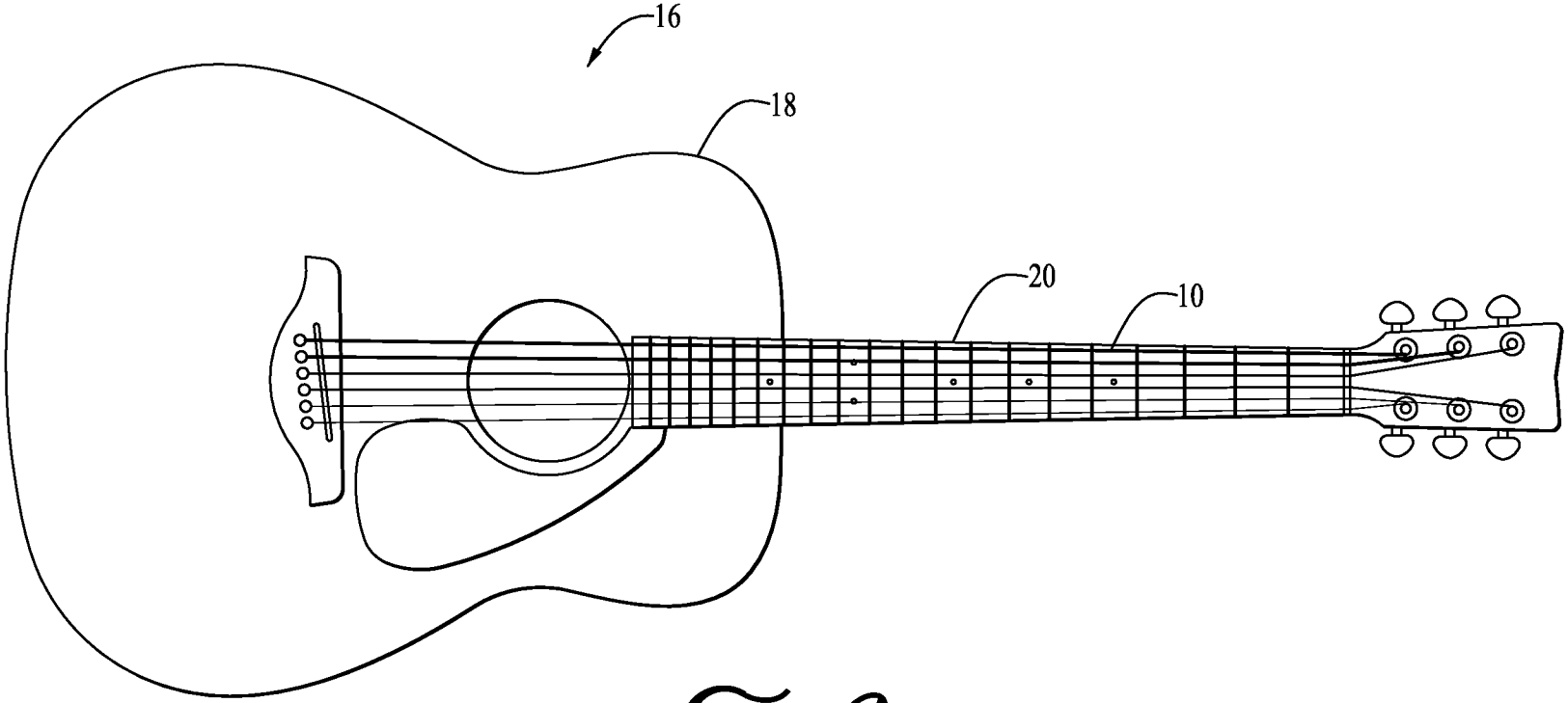
FIG. 3 is a side view of a musical instrument having features of the invention.

In another aspect of the invention, the invention is a musical instrument 16 comprising a body 18, a neck 20 and a plurality of instrument strings. The plurality of instrument strings are disposed along the front of the body 18 and along the neck 20. In this aspect of the invention, the plurality of strings includes at least one wound string 10 of the invention, as described above. One embodiment of this aspect of the invention is illustrated in FIG. 3 wherein the musical instrument 16 is an acoustic guitar.

Example

Audio output comparison testing was made on (i) a wound phosphor bronze musical string having a thickness of 0.056" diameter and (ii) a wound aluminum bronze musical string having a thickness of 0.056" diameter.

Comparison testing was conducted on a testing apparatus with an automated plucking mechanism to ensure the strings were plucked with exactly the same attack. Except for the difference in strings, the comparison testing was carried out under essentially identical conditions.

In the comparison testing, each string was evaluated by using a guitar plucking mechanism which plucks each test string identically. The signal from each pluck was recorded using specialized software for evaluating sound profiles.

Figure 4:
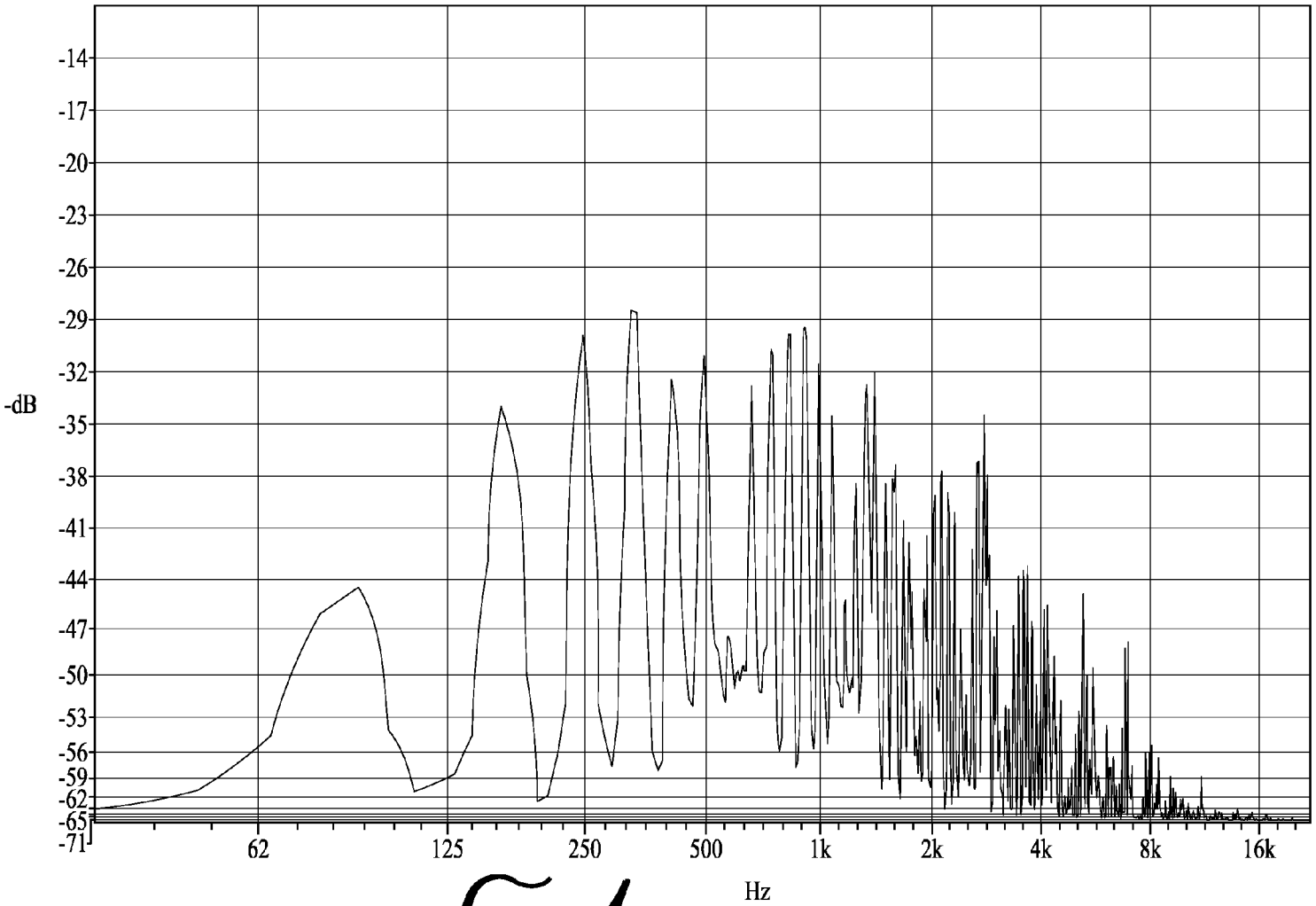
FIG. 4 PRIOR ART
FIG. 4 is a graphical display showing audio output data for a musical string of the prior art.
Figure 5:
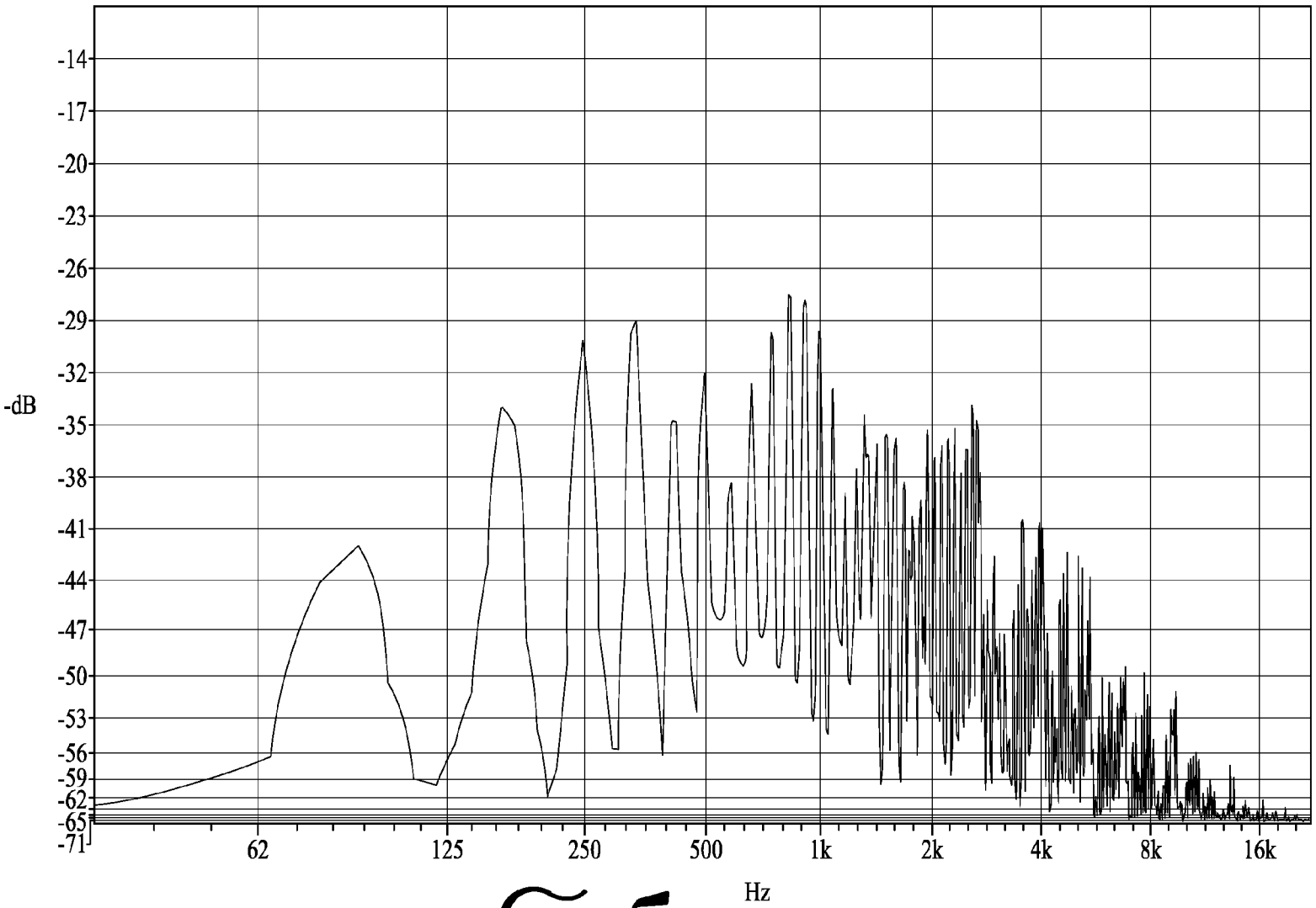
FIG. 5 is a graphical display showing audio output data for a musical string having features of the invention.

The results of the comparison testing are illustrated in FIGS. 4 (phosphor bronze musical string) and 5 (aluminum bronze musical string). FIGS. 4 and 5 are peak frequency responses of the recorded output data for each string. In FIGS. 4 and 5, the x-axes indicate the frequency and the y-axes indicates the intensity.

As can be seen by comparing FIG. 4 with FIG. 5, the aluminum bronze string has a significantly stronger fundamental frequency as well as higher order harmonics compared to a phosphor bronze string which indicates a fuller sounding string with added clarity and brightness.

Having thus described the invention, it should be apparent that numerous structural modifications and adaptations can be resorted to without departing from the scope and fair meaning of the instant invention as set forth hereinabove and as described herein below by the claims.

What is claimed is:

1. A string for a musical stringed instrument comprising:

(a) a core wire; and (b) a wrap wire coiled tightly around the core wire, the wrap wire comprising an aluminum-copper alloy comprising between about 2 wt % and about 10 wt % aluminum.

2. The string of claim 1 wherein the aluminum-copper alloy comprises greater than about 85 wt % copper.

3. The string for a musical instrument of claim 1 wherein the weight percent of aluminum in the aluminum-copper alloy is between about 5 wt % and about 6 wt.

4. The string of claim 3 wherein the aluminum-copper alloy comprises greater than about 90 wt % copper.

5. The string for a musical instrument of claim 1 wherein the alloy further comprises up to about 2 wt % of one or more of the following metals: nickel, iron, manganese and arsenic.

6. A musical stringed instrument comprising:

(a) a body;

(b) a neck appended to and extending away from the body; and (c) a plurality of strings taughtly disposed along the front of the body and along the neck, the plurality of strings including at least one string of claim 1.

7. The musical instrument of claim 6 wherein the weight percent of aluminum in the aluminum-copper alloy is between about 5 wt % and about 6 wt %, with copper constituting at least 90 wt % of the remainder of the alloy.

8. The musical instrument of claim 6 comprising up to about 2 wt % of one or more of the following metals: nickel, iron, manganese and arsenic.

9. The musical instrument of claim 6 wherein the musical instrument is an acoustic musical instrument.

10. The musical instrument of claim 6 wherein the musical instrument is an acoustic guitar.

* * * * *